US006422981B1

(12) United States Patent
Riser

(10) Patent No.: US 6,422,981 B1
(45) **Date of Patent: *Jul. 23, 2002**

(54) TRANSPORTABLE STRETCHING SYSTEM

(76) Inventor: Daniel E. Riser, 1900 S. Ocean Blvd. 11V, Pompano Beach, FL (US) 33062

( * ) Notice: Subject to any disclaimer, the term of this patent is extended or adjusted under 35 U.S.C. 154(b) by 0 days.

This patent is subject to a terminal disclaimer.

(21) Appl. No.: 09/649,019

(22) Filed: Aug. 28, 2000

Related U.S. Application Data

(63) Continuation-in-part of application No. 09/225,222, filed on Jan. 4, 1999, now Pat. No. 6,110,083.

(51) Int. Cl.[7] ..... A63B 26/00
(52) U.S. Cl. ..... 482/142; 482/907; 482/95
(58) Field of Search ..... 482/142, 907, 482/95, 127, 121, 904, 96, 91, 92, 94

(56) References Cited

U.S. PATENT DOCUMENTS

| | | | | | |
|---|---|---|---|---|---|
| 3,117,782 | A | | 1/1964 | Johnston | 272/81 |
| 3,664,666 | A | * | 5/1972 | Llyod | |
| 3,999,752 | A | | 12/1976 | Kupperman et al. | 272/126 |
| 4,084,815 | A | * | 4/1978 | Flannery | 482/96 |
| 4,257,592 | A | | 3/1981 | Jones | 272/126 |
| 4,277,062 | A | | 7/1981 | Lawrence | 272/126 |
| 4,696,470 | A | | 9/1987 | Fenner | 272/144 |
| 4,988,096 | A | | 1/1991 | Jones | 272/118 |
| 5,024,214 | A | | 6/1991 | Hayes | 128/75 |
| 5,067,709 | A | | 11/1991 | Christianson | 272/121 |
| 5,160,305 | A | | 11/1992 | Lin | 482/138 |
| 5,181,289 | A | * | 1/1993 | Kassi | 482/133 |
| 5,261,865 | A | | 11/1993 | Trainor | 482/95 |
| 5,277,680 | A | | 1/1994 | Johnston | 482/95 |
| 5,286,242 | A | | 2/1994 | Johnston | 482/95 |
| 5,405,306 | A | | 4/1995 | Goldsmith et al. | 482/120 |
| 5,417,636 | A | * | 5/1995 | Havens | 482/145 |
| 5,449,336 | A | * | 9/1995 | Sabel | 482/133 |
| 5,520,615 | A | | 5/1996 | Fontana et al. | 601/33 |
| 5,529,562 | A | | 6/1996 | Glaser | 482/146 |
| 5,551,934 | A | * | 9/1996 | Binette | 482/123 |
| 5,558,607 | A | | 9/1996 | Darling | 482/95 |
| 5,634,873 | A | | 6/1997 | Carlstrom | 482/95 |
| 6,110,083 | A | * | 8/2000 | Riser | 482/142 |

* cited by examiner

*Primary Examiner*—Jerome W. Donnelly
(74) *Attorney, Agent, or Firm*—Lee & Sterba, P.C.

(57) ABSTRACT

A portable stretching apparatus can be deployed in a manner that allows one limb of a user to be restrained on a base unit supporting the user's body while another limb is stretched by pulling a cable at one end to move the other limb attached at the other end of the cable. A cable handling device is arranged so that it can be moved at any position across the width of the stretching device. A measuring device allows a user to measure the relative extent of a stretching exercise.

20 Claims, 5 Drawing Sheets

TRANSPORTABLE STRETCHING SYSTEM

This is a continuation in part of application Ser. No. 09/225,222, filed Jan. 4, 1999 now U.S. Pat. No. 6,110,083.

BACKGROUND OF THE INVENTION

1. Field of the Invention

The invention concerns an apparatus for stretching muscles and associated tissues of the human body. In particular, the present invention is directed to a stretching apparatus and system that can accommodate a wide variety of stretching exercises for many different body sizes and levels of flexibility.

2. Description of Related Art

It is well known that stretching muscles and associated soft tissues of the human body prior to and subsequent to exercise is advantageous for a number of different reasons. a Such stretching lengthens the muscles, thus achieving greater range of motion at a joint. Stretching also reduces the risk of injury during subsequent exercising and everyday activity.

There are at least four disadvantages of conventional stretching devices. First, conventional stretching devices generally cannot be reconfigured into a single, readily transported package. Second, conventional stretching devices generally do not accommodate a wide range of different body sizes, shapes and levels of flexibility. Third, conventional stretching devices are generally applicable to only a limited number of muscles and/or cannot focus on stretching a specific muscle. For example, many of the convention devices for stretching a particular muscle group, such as the thigh muscles, are not capable of stretching other muscle groups, such as the gluteus muscles, or capable of stretching a specific muscle, such as the inner thigh muscle. Fourth, the conventional stretching devices generally do not provide a way of measuring the quality and assessing the progress of a stretching regimen.

SUMMARY OF THE INVENTION

An objective of the present invention is to provide an apparatus for stretching muscles that overcomes the disadvantages of conventional stretching devices.

It is an another object of the present invention to provide an apparatus for stretching that is readily transportable as a single unit.

It is yet another object of the present invention to provide an apparatus for stretching that is sufficiently adaptable so that a wide range of body shapes, sizes and levels of flexibility can be accommodated.

It is a further object of the present invention to provide an apparatus for stretching having a full range of stretching exercises for a wide variety of specific muscles.

It is yet a further object of the present invention to provide an apparatus for stretching that includes a feature for measuring the quality and assessing the progress of a stretching regimen.

These and other objects are achieved according to the present invention by an apparatus for stretching a muscle associated with a limb of a human body. The apparatus comprises a base having a first panel and a second panel, the first and second panels generally overlying one another in a collapsed configuration of the base, and the first and second panels adapted for underlying the human body in an expanded configuration of the base; a restraint adapted for securing the body with respect to the first panel; a cable having a first end secured with respect to the second panel and a second end adapted to be displaced relative to the second panel; and an attachment having a first cable guide, the attachment adapted for securing the first cable guide with respect to the limb, and the first cable guide receiving an intermediate portion of the cable between the first and second ends.

In accordance with a second embodiment of the present invention, there is provided an apparatus for exercising a muscle of a human body, comprising:

a base having a first panel and a second panel;

a cable having a first end secured at a first position with respect to the second panel and a second end adapted to be displaced relative to the second panel, the first position being adjustable with respect to the second panel;

an attachment having a first cable guide, the attachment adapted for securing the first cable guide with respect to the limb, and the first cable guide receiving an intermediate portion of the cable between the first and second ends;

a second cable guide retained at a second position adjustable along a width of the base, the second cable guide receiving a second intermediate portion of the cable between the first cable guide and the second end; and a sliding bar mounted on the second panel, the first position being located along the sliding bar, the sliding bar having gripper portions along the length thereof whereby a user of the apparatus may grip the sliding bar.

The cross-section of the sliding bar may be a square, a rectangle or a circle.

In accordance with a third embodiment of the present invention, there is provided an apparatus for exercising a muscle of a human body, comprising:

a base having a first panel and a second panel;

a cable having a first end secured at a first position with respect to the second panel and a second end adapted to be displaced relative to the second panel, the first position being adjustable with respect to the second panel;

an attachment having a first cable guide, the attachment adapted for securing the first cable guide with respect to the limb, and the first cable guide receiving an intermediate portion of the cable between the first and second ends;

a second cable guide retained at a second position adjustable along a width of the base, the second cable guide receiving a second intermediate portion of the cable between the first cable guide and the second end;

a sliding bar mounted on the second panel, the first position being located along the sliding bar; and gripper means attached to the second panel whereby a user of the apparatus may grip the gripper means using the user's hands.

In the third embodiment, the gripper means may be integral with at least one leg of an upright support structure of the apparatus. The gripper means may comprise a tubular member. The gripper means may comprise a handle device adapted to fit a human hand. The gripper means may further comprise a U-shaped handle.

In the third embodiment, the gripper means may be attached to the second panel adjacent at least one leg of an upright support structure of the apparatus. The gripper means may also be foldably attached to the second panel.

In the third embodiment, the gripper means may comprise a bar that runs parallel with the sliding bar, and the cross-section of the sliding bar may be a square, a circle or a rectangle.

In a fourth embodiment of the present invention, there is provided an apparatus for exercising a muscle of a human body, comprising. a base having a top end and a bottom end;

a cable having a first end secured at a first position with respect to the top end of the base and a second end adapted to be displaced relative to the base;

an attachment having a first cable guide, the attachment adapted for securing the first cable guide with respect to the limb, and the first cable guide receiving an intermediate portion of the cable between the first and second ends;

a second cable guide retained at a second position adjustable along a width of the top end of the base, the second cable guide receiving a second intermediate portion of the cable between the first cable guide and the second end; and gripper means attached to the top end of the base whereby a user of the apparatus may grip the gripper means using the user's hands.

In the fourth embodiment, the gripper means may be integral with at least one leg of an upright support structure of the apparatus, and the gripper means may comprise a tubular member. The gripper means may comprise a handle device adapted to fit a human hand, and the gripper means may comprise a U-shaped handle. The gripper means may be attached to the base adjacent at least one leg of an upright support structure of the apparatus, and the gripper means may be foldably attached to the base. The gripper means may comprise a bar that runs parallel with a sliding bar, and the cross-section of the sliding bar may be a square, a circle or a rectangle.

The accompanying drawings show illustrative embodiments of the present invention from which these and other of the objectives, novel features and advantages will be readily apparent.

DETAILED DESCRIPTION OF THE INVENTION

Figure 2:
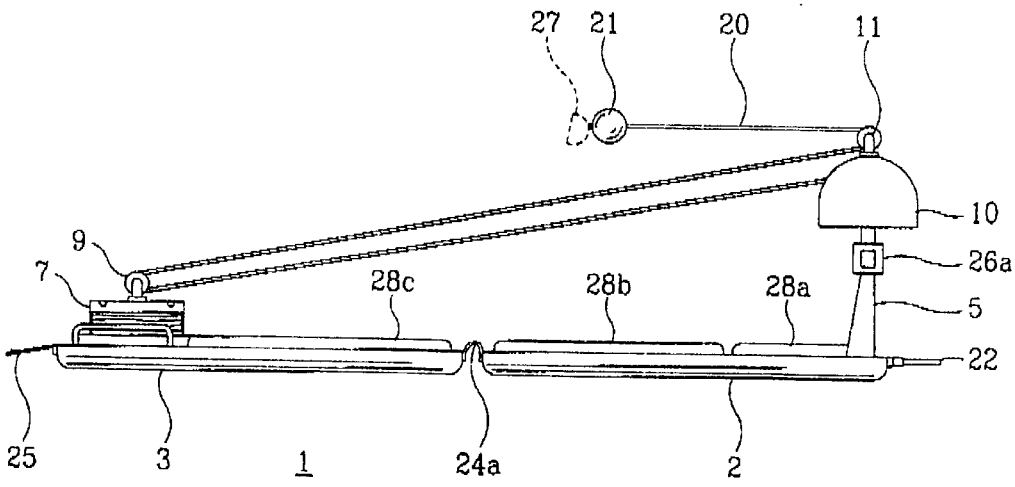
FIG. 2 is a side view showing the first embodiment of the present invention in its expanded configuration.

A stretching apparatus 1 according to a first preferred embodiment of the present invention comprises a portable base structure having two panels 2 and 3. In use, the apparatus 1 is deployed on a floor or other generally horizontal surface such that the base structure 2,3 may support a user's body. Preferably, the top of the base structure 2,3 is covered with padded sections 28(*a*)–(*c*), as depicted in FIG. 2. The one or more of the padded sections 28(*a*)–(*c*), in conjunction with the lower surfaces of the two panels 2,3 of the base structure, may define a cavity that is capable of holding portions of the stretching apparatus as will described below with reference to FIGS. 4, 5(*a*) and 5(*b*).

Figure 1:
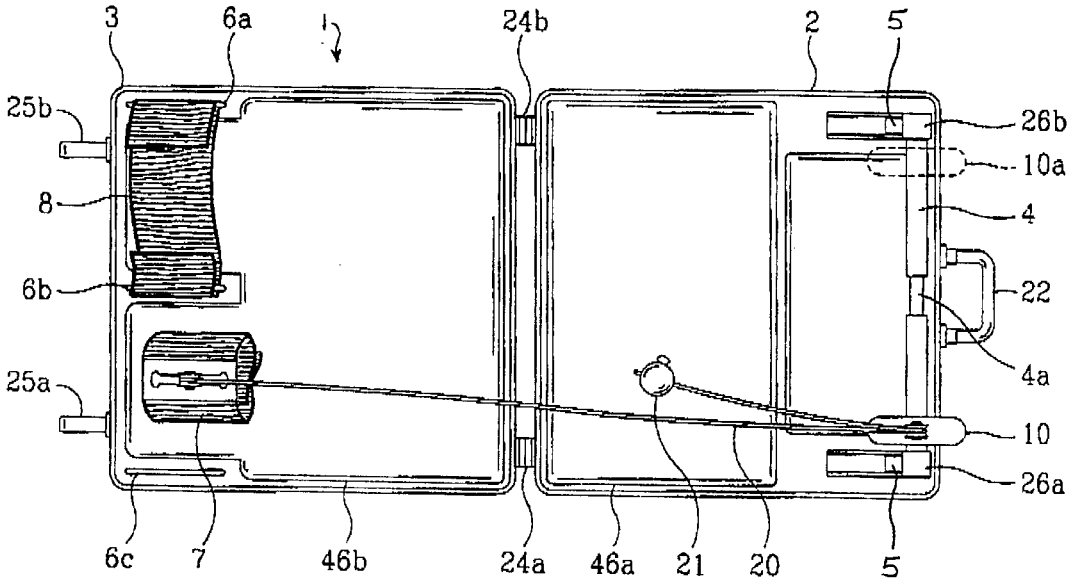
FIG. 1 is a top view showing a first embodiment of the present invention in its expanded configuration.

When fully expanded, the first embodiment of the present invention includes an upright support structure including at least one leg 5. According to a preferred embodiment of the present invention, as depicted in FIGS. 1 and 2, two legs 5 are arranged on opposite sides of the panel 2 in proximity to each of the opposite lateral sides of panel 2. The legs 5 are pivotally connected with respect to the panel 2 so as to pivot between folded and erected positions. The legs 5 are placed in the folded position in the collapsed configuration of the apparatus 1, and are placed in the erected position in the expanded configuration of the apparatus 1 (FIGS. 1 and 2).

Figure 4:
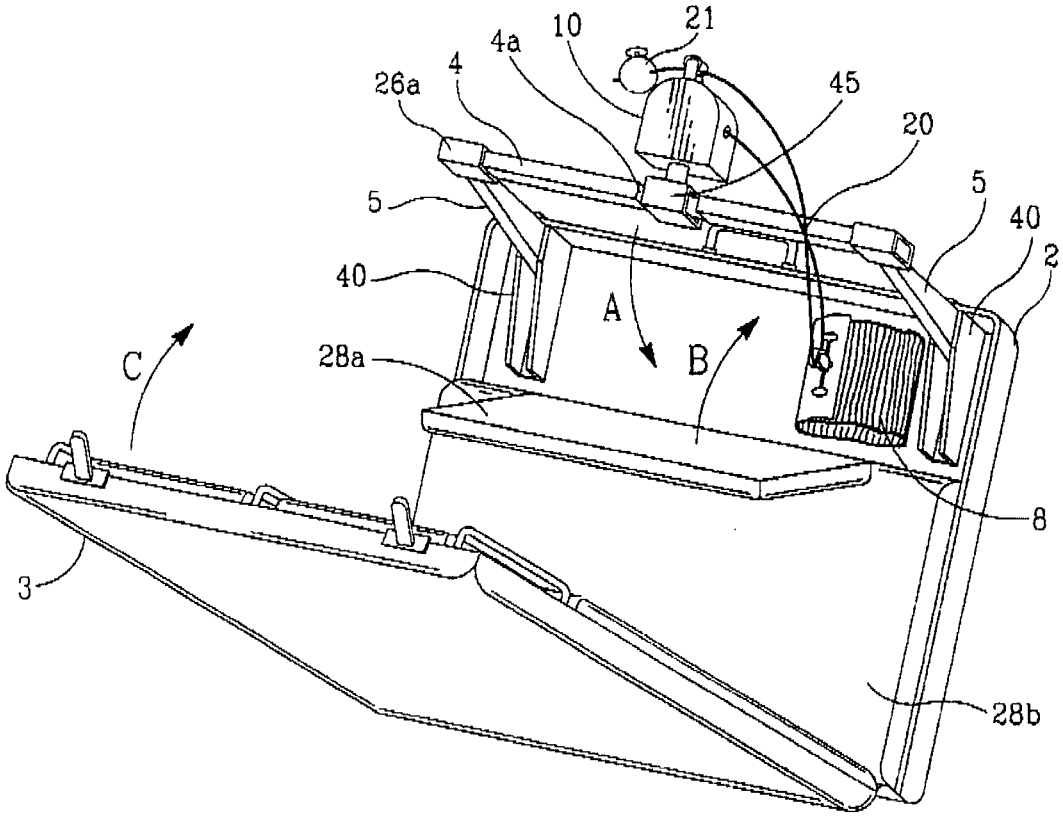
FIG. 4 is a perspective view of the first embodiment of the present invention in an intermediate position between its expanded and collapsed configurations.

A horizontal cross piece or sliding bar 4 extends between the legs 5. A cable handling mechanism 10 is adjustably positioned along the sliding bar 4 using a sliding support member 45 (FIG. 4). According to a preferred embodiment of the present invention, the cross-sectional shape of sliding bar 4 is square or rectangular, and is received in a correspondingly shaped opening in the sliding support member 45. A relatively close fit between sliding bar 4 and sliding support member 45 provides the support necessary to maintain the position of the cable handling mechanism 10 along the sliding bar 4 while still allowing positional adjustment of the cable handling mechanism 10 along the entire length of sliding bar 4. The dotted outline 10(*a*) of the cable handling mechanism depicts the opposite extreme of the positioning available with this arrangement. The cable handling mechanism 10 is prevented from sliding off of the sliding bar 4 by end pieces 26(*a*) and 26(*b*) that can be formed as integral parts of the legs 5. The ability to slide the cable handling mechanism 10 across the length of the sliding bar 4 provides a wide range of different stretching exercises for a variety of different muscles. The cable handling mechanism 10 may also include a lock (not shown) for positively securing the cable handling mechanism 10 at virtually any position along the sliding bar 4.

According to the first preferred embodiment of the present invention, a first end of a cable 20 is secured in an interior compartment of the cable handling mechanism 10. An intermediate portion of the cable 20 is slidably received in a first cable guide or pulley 9 on a limb attachment device or cuff 7. The cable 20 then runs back to a second cable guide or pulley 11 mounted on the cable handling mechanism 10 where a second intermediate portion the cable 20 is received by the second pulley 11. The cable 20 then extends to a second end at which a cable holder 21 and a measuring device may be arranged. Alternatively, the second end of the cable 20 may simply be fitted with a handle 27 facilitating a secure grasp of the second end.

The user generally lies in a supine position on the apparatus 1 with his or her head lying on the panel 2 having the support structure 4,5. One of the user's limbs is held in the limb attachment or cuff 7, which is preferably made of a fabric with at least one or more loop and pile type fastener. However, other materials (including both flexible and rigid materials) can be used to make the limb attachment 7, and other fastening means can be used besides a loop and pile type fastener. The other limb is restrained firmly with respect to the panel 3 by way of a limb restraint or holding strap 8, which is also preferably made of fabric with at least one loop and pile type fastener. However, other materials and fastening systems can also be used. According to a preferred embodiment of the present invention, the restrained limb of the user is held on the panel 3 through the use of two out of three U-shaped brackets 6(*a*)–(*c*). As a result, when the user pulls the second end of cable 20, the limb attached to cuff 7 is pulled by the cable 20 while the other limb is firmly restrained in place on the panel 3 by the strap 8.

Figure 3:
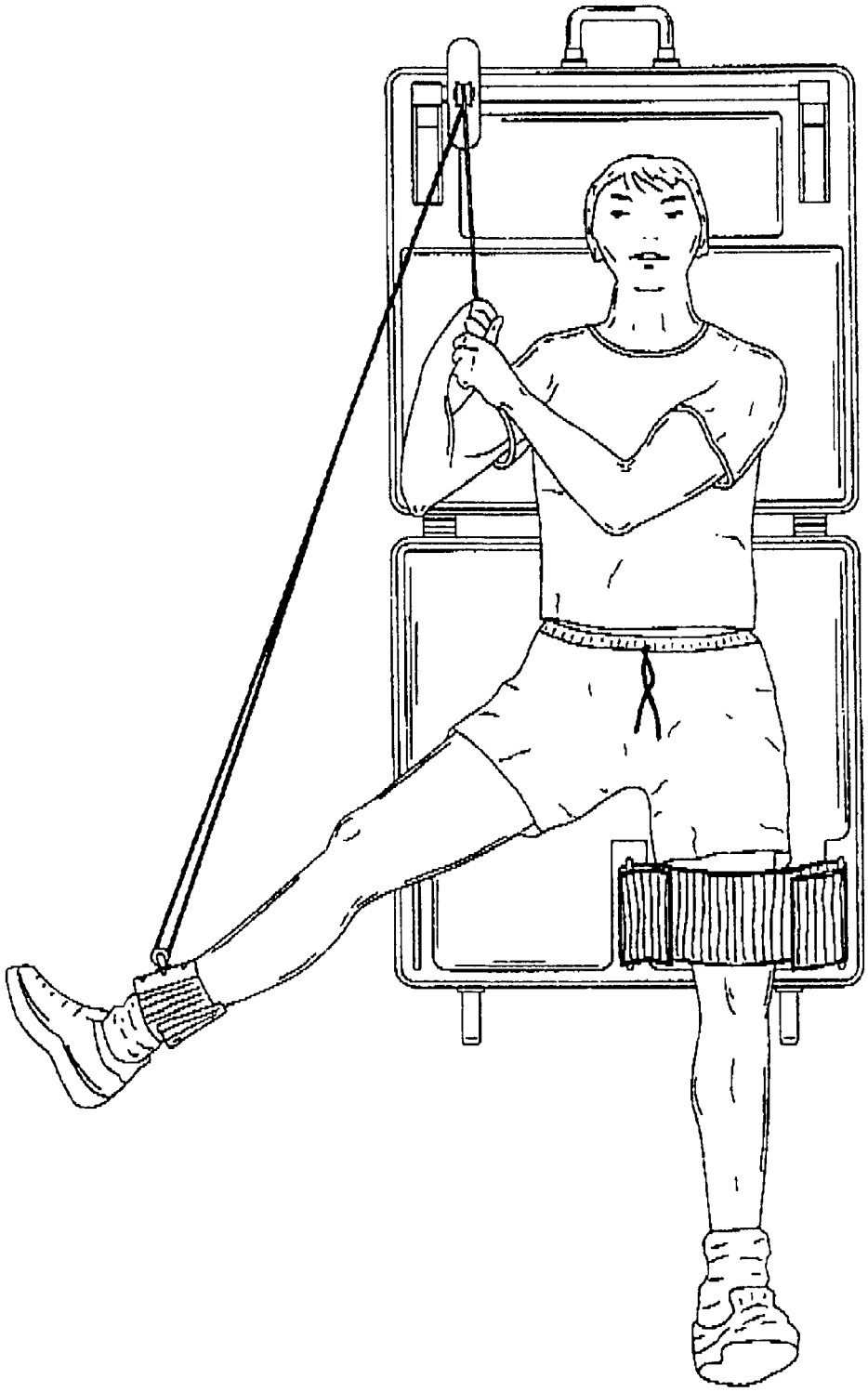
FIG. 3 is a top view illustrating the operation of the first embodiment of the present invention by a user.

By moving the cable handling mechanism 10 along the sliding bar 4, the user is able to position the cable handling mechanism 10 for a specific stretching exercise targeting a particular muscle or muscle group. The wide variation is best exemplified in FIG. 3 which depicts the stretching of one set of muscles when the cable handling mechanism 10 is locked at a first position. Clearly, if the cable handling mechanism 10 is locked at another position along the sliding bar 4, different muscles will be stretched when the user pulls on cable 20.

Because the three U-shaped brackets 6(*a*)–(*c*) are located on panel 3 of the apparatus 1, either of the user's legs can be restrained firmly on the panel 3. Thus, a full range of stretching angles and positions can be achieved that stretch a wide range of muscles in either leg. This flexibility is also enhanced through the use of the cable guide or pulley 9 on the cuff 7, as well as the second cable guide or pulley 11 on the cable housing 10. These cable guides increase the mechanical advantage that may be achieved by the user pulling on the second end of the cable 20. Adjustably mounting the cable guides 10,11 gives the user full advantage of the wide range of positions made available through the sliding movement of the cable handling mechanism 10 along the sliding bar 4.

According to a preferred embodiment of the present invention, the apparatus 1 is transported to a desired location and opened to its expanded configuration on a generally horizontal surface. A user then secures a first limb in the cuff 7 and restrains a second limb with the strap 8 before lying down on the panels 2,3. The user will most often lie in a supine position on the panels 2,3; however, it is envisioned that the user may lie in a prone position for stretching certain muscles. Thus, in the expanded configuration of the apparatus 1 shown in FIGS. 1–3 the pad sections 28(*a*)–28(*c*) establish an essentially flat structure that underlies the user in the expanded configuration of the apparatus 1.

When the user pulls on the second end of the cable 20, the cuff 7 is displaced relative to the strap 8, and the first limb is moved relative to the second limb. Tension in the cable 20 stretches a desired muscle at the limit of the range of motion for that muscle.

According to a preferred embodiment of the present invention, cable 20 is nylon rope, approximately ⅜ inch in diameter. However, it is envisioned that different sizes and other materials, e.g., steel cables, can also be used in the present invention without departing from the inventive concepts.

According to a preferred embodiment of the present invention, it is often more convenient for a user to grasp a handle 27 (shown as an optional device with dotted lines in FIG. 2), than to simply grasp the second end of the cable 20. The arrangement of the handle 27 may include a wide range of shapes including a straight bar, a curved bar, a ball, a ring, etc.

According to a preferred embodiment of the present invention, the apparatus may comprise a system for measuring, in relative terms, the extent of a stretch. According to a most preferred embodiment, the measuring system comprises a spherical cable holder 21 (shown in FIGS. 2 and 6(*a*)) that is releasably attached along the cable 20 near its second end, and measuring gradations (not shown) marked on the cable 20.

Figure 6A:
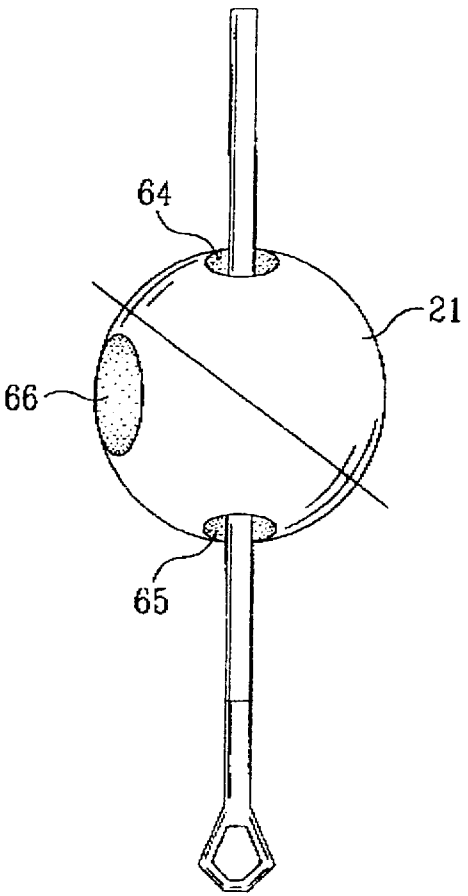
FIGS. 6(*a*)–(*c*) are detail views of components of the measuring device according to the first embodiment of the present invention.
Figure 6C:
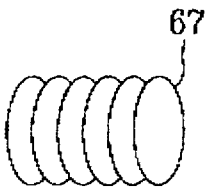
Figure 6B:
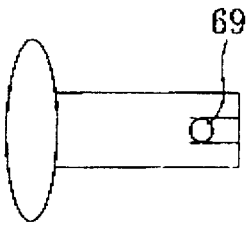

As shown in FIG. 6(*a*), the cable 20 enters the cable holder 21 through a hole 64 and exits through another hole 65. Inside the cable holder 21, the cable 20 also passes through an opening 69 in a pushbutton 68. When the pushbutton 68 is depressed, the cable 20 slides freely through the cable holder 21 because the holes 64,65 and the opening 69 are mutually aligned. Normally, i.e., when the pushbutton 68 is not depressed, a spring 67 biases the pushbutton 68 outward through an opening 66. Thus, the opening 69 is displaced relative to the holes 64,65, thereby pressing and holding the cable 20 with respect to the cable holder 21.

Moving the cable holder 21 to different marks along the cable 20 allows a user to measure the relative extent of his or her stretching. For example, if a muscle is stretched to a first extent with the cable holder 21 located at a first position, a relatively greater stretch to a second extend is achieved when the cable holder 21 is moved with respect to the cable 20 so as to shorten the length of the cable 20 between the cuff 7 and the cable holder 21. Of course, the second end of the cable 20 must be pulled to the same degree during each stretch. Thus, the marks on the cable 20 provide calibrations for measuring the extent of a stretch relative to previous stretches of each muscle, and thereby enable a user to track the relative progression of a stretching regimen for a particular muscle.

Alternatively or in addition to using preestablished reference marks on the cable 20, the user may place reference mark(s) on the cable 20 by a number of different techniques, including but not limited to, pen marks, rubber bands, washers, or any other technique that allows a reference point to be established. According to another preferred embodiment of the present invention, the cable holder 21 may include a device for measuring its position along the cable 20. For example, a mechanical or electrical gauge installed within cable holder 21 can measure and indicate the distance the cable holder 21 is moved along the cable 20 relative to the second end of the cable 20. Any number of conventional sensing mechanisms can be used to measure the amount of cable 20 passing through the cable holder 21.

Further, the cable holder 21 need not have a spherical shape with a pushbutton as depicted in FIGS. 6(*a*)–(*c*), but can have any shape and mechanism that allows it to be held easily by the user and ensures that the relative position of the cable holder 21 can be securely maintained along the length of the cable 20. The essential feature is that a user be able to hold the measuring device at predetermined calibration point of the user's choosing, and be able to consistently pull the cable 20 to evaluate the extent of a stretch.

Figure 5:
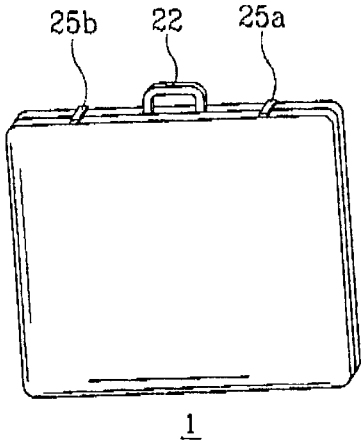
FIG. 5 is a perspective view of the present invention in its collapsed configuration.

The transportability of the present invention is best depicted in FIGS. 4 and 5. The two panels 2,3 are preferably connected with respect to one another in a clamshell relationship by flexible structures such as hinges 24(*a*) and 24(*b*) so that they can fold against each other in a direction depicted by arrow C (FIG. 4). The result is the collapsed configuration of the apparatus 1 as depicted in FIG. 5. Such a collapsed configuration may be secured by latches 25(*a*) and 25(*b*) that hold the two panels 2,3 together. The apparatus 1 is then easily transported by means of a handle 22.

In order to facilitate the collapsed configuration depicted in FIG. 5, it is necessary for the legs 5 to be folded with respect to panel 2 by pivoting the legs 5 in the direction depicted by arrow A. Each leg 5 is pivoted within a respective horizontal bracket 40 mounted on the panel 2. As a result, both the legs 5 and the sliding bar 4 are able to be folded flat against the bottom of panel 2 in a cavity formed when pad 28(*a*) is temporarily tipped into a vertical position as depicted in FIG. 4.

In order for legs 5 and the sliding bar 4 to lie flat against section 2 of the base structure, the cable handling mechanism 10 must be rotated about the sliding bar 4. Such rotation is facilitated by an indentation 4(*a*) in the sliding bar 4. The indentation 4(*a*) may have a smaller cross-section than the rest of the sliding bar 4 and/or the indentation 4(*a*) may have a differently shaped cross-section, e.g., round. The indentation 4(*a*) allows the sliding support member 45 to disengage from the sliding bar 4 so that the cable handling mechanism 10 can be rotated around the sliding bar 4. According to a preferred embodiment of the present invention, this rotation is opposite in direction to that of the legs 5. As a result, all of these elements can be arranged to lie flat against the inner bottom surface of panel 2, underneath the pad 28(*a*). Cable 20 and limb restraint 8 may also be stored in the cavity formed between the pad 28(*a*) and the bottom of the compartment created by the bottom inner surface of panel 2.

In the collapsed configuration of the apparatus 1, the U-shaped brackets 6(*a*),6(*c*) are received on either side of the horizontal support brackets 40(*a*),40(*b*) so that these elements do not interfere with each other when the two panels 2,3 of the base structure are folded against each other. According to a preferred embodiment of the present invention, the center U-shaped bracket 6(*b*) may be removed in the collapsed configuration. Alternatively, the bracket 6(*b*) can be arranged to extend only slightly higher than pad 28(*c*) so that when the two panels 2,3 are closed against each other, bracket 6(*b*) will not damage the pad 28(*a*).

The flexible connectors facilitating the clamshell connection between the panels 2,3 may comprise leather hinges 24(*a*),24(*b*) that would allow a certain amount of relative displacement between the two panels 2,3 in addition to allowing relative pivotal motion. However, other types of hinge arrangements may also be used. The latches 25(*a*),25(*b*) may hold the two panels 2,3 together tightly in the collapsed configuration of the apparatus 1. The pad sections 28(*a*)–28(*c*) can be supported on the panels 2,3 in a variety of fashions in order to provide one or more storage cavities between the pads 28(*a*)–28(*c*) and the inner bottom surfaces of the panels 2,3. According to one preferred embodiment of the present invention, rubber spacers (not shown) are arranged at intervals to support the pad sections 28(*a*)–28(*c*) at a distance from the inner bottom surfaces of the panels 2,3. However, an alternative arrangement includes lips 46(*a*) and 46(*b*) (FIG. 1) on the upper surface of the panels 2 and 3, respectively, that support edges of the pad sections 28(*a*)–28(*c*). The pad sections 28(*a*) and 28(*b*) can be hinged to each other or allowed to rest separately on the supports provided with respect to panel 2. In another alternative, the pads 28(*b*) and 28(*c*) can be formed so as to fill the area from the top surface of the pad to the bottom of the respective section 2,3 of the base structure, so that no cavities are formed except for the area underneath pad 28(*a*).

According to a preferred embodiment of the present invention, the cable handling mechanism 10 may include a retracting mechanism (not shown). This mechanism can be a spring-biased reel device such as has been used with retractable electrical cords on conventional household appliances, e.g., vacuum cleaners. In the alternative, the retracting device can be operated by electrical power provided by either a battery or a connection to a standard wall outlet. By using the retracting device contained within the cable handling mechanism 10, the stretching apparatus 1 becomes easier to pack and arrange in its collapsed configuration. In use, the cable 20 remains attached to the cable handling mechanism 10 but is otherwise fully deployed from the cable housing mechanism.

Figure 7:
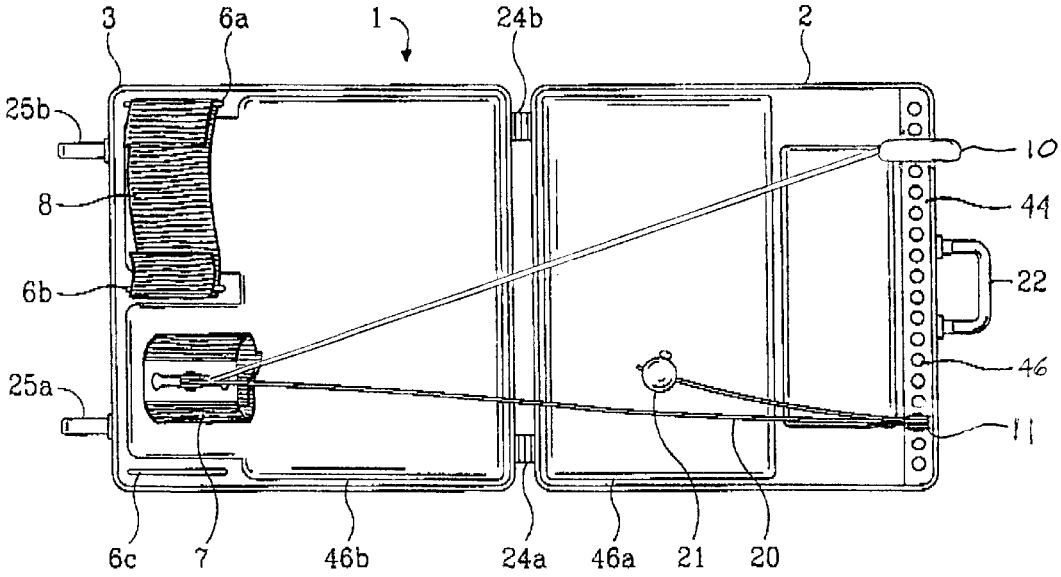
FIG. 7 is a top view showing a second embodiment of the present invention in its expanded configuration.
Figure 8:
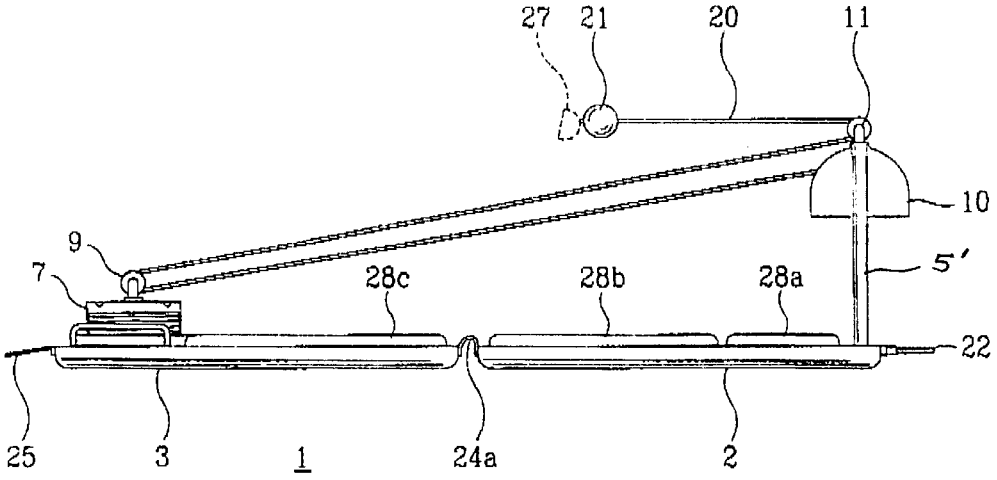
FIG. 8 is a side view showing the second embodiment of the present invention in its expanded configuration.

FIGS. 7 and 8 show another preferred embodiment of the present invention that includes several variations envisioned by the inventor. In lieu of the brackets 40, a support 44 is secured to the panel 2. The support 44 includes a plurality of holes 46 along its length for receiving legs 5' at different positions along the width of the panel 2. Instead of sliding the cable handling mechanism 10 along the sliding bar 4, as in the embodiment illustrated in FIGS. 1 and 2, the cable handling mechanism 10 is positionable along the panel 2 by inserting a leg 5' in a desired hole 46 for performing a specific stretching exercise.

In lieu of mounting the second cable guide or pulley 11 directly on the housing, it is also envisioned that the second cable guide or pulley 11 may be positioned with respect to the panel 2 at a first location that is spaced apart from a second location at which the cable handling mechanism 10 is positioned with respect to the panel 2. Specifically, it is envisioned that each of the cable handling mechanism 10 and the second cable guide or pulley 11 may be mounted on respective legs 5' that are inserted into spaced apart ones of the holes 46. As best shown in FIG. 7, laterally separating the cable handling mechanism 10 establishes two divergent lines of action (i.e., between cable handling mechanism 10 and cuff 7, and between cuff 7 and second cable guide or pulley 11) that may be useful in stabilizing and controlling the motion of the first limb during a stretching exercise.

Although the advantages of separating the cable handling mechanism 10 from the second cable guide or pulley 11 have been discussed with the preferred embodiment illustrated in FIGS. 7 and 8, the same advantages may also be obtained by modifying the preferred embodiment illustrated in FIGS. 1–4. In particular, the second cable guide or pulley 11 may be independently mounted on the sliding bar 4 with respect to the cable handling mechanism 10, or the second cable guide or pulley 11 may be mounted on the panel 2 independently of both the cable handling housing 10 and the sliding bar 4. Similarly, as in the preferred embodiment illustrated in FIGS. 1–4, the second cable guide or pulley 11 may be directly mounted on the cable handling housing 10 in the preferred embodiment illustrated in FIGS. 7 and 8.

While a number of embodiments have been disclosed by way of example, the present invention should not be construed to be limited thereby. Rather, the present invention should be interpreted to include all variations, embodiments, modifications, permutations and adaptations that would occur to one skilled in this art who has been taught the present invention by the instant application.

What is claimed is:

1. An apparatus for exercising a muscle of a human body, comprising:

a base having a first panel and a second panel;

a cable having a first end secured at a first position with respect to the second panel and a second end adapted to be displaced relative to the second panel, the first position being adjustable with respect to the second panel;

an attachment having a first cable guide, the attachment adapted for securing the first cable guide with respect to the limb, and the first cable guide receiving an intermediate portion of the cable between the first and second ends;

a second cable guide retained at a second position adjustable along a width of the base, the second cable guide receiving a second intermediate portion of the cable between the first cable guide and the second end; and a sliding bar mounted on the second panel, the first position being located along the sliding bar, the sliding bar having gripper portions along the length thereof whereby a user of the apparatus may grip the sliding bar.

2. The apparatus as claimed in claim 1, wherein a cross-section of the sliding bar is a square, a rectangle or a circle.

3. An apparatus for exercising a muscle of a human body, comprising:

a base having a first panel and a second panel;

a cable having a first end secured at a first position with respect to the second panel and a second end adapted to be displaced relative to the second panel, the first position being adjustable with respect to the second panel;

an attachment having a first cable guide, the attachment adapted for securing the first cable guide with respect to the limb, and the first cable guide receiving an intermediate portion of the cable between the first and second ends;

a second cable guide retained at a second position adjustable along a width of the base, the second cable guide receiving a second intermediate portion of the cable between the first cable guide and the second end;

a sliding bar mounted on the second panel, the first position being located along the sliding bar; and gripper means attached to the second panel whereby a user of the apparatus may grip the gripper means using the user's hands.

4. The apparatus of claim 3, wherein the gripper means is integral with at least one leg of an upright support structure of the apparatus.

5. The apparatus of claim 3, wherein the gripper means comprises a tubular member.

6. The apparatus of claim 3, wherein the gripper means comprises a handle device adapted to fit a human hand.

7. The apparatus of claim 4, wherein the gripper means comprises a U-shaped handle.

8. The apparatus of claim 3, wherein the gripper means is attached to the second panel adjacent at least one leg of an upright support structure of the apparatus.

9. The apparatus of claim 8, wherein the gripper means is foldably attached to the second panel.

10. The apparatus of claim 3, wherein the gripper means comprises a bar that runs parallel with the sliding bar.

11. The apparatus of claim 3, wherein a cross-section of the sliding bar is a square, a circle or a rectangle.

12. An apparatus for exercising a muscle of a human body, comprising:

a base having a top end and a bottom end;

a cable having a first end secured at a first position with respect to the top end of the base and a second end adapted to be displaced relative to the base;

an attachment having a first cable guide, the attachment adapted for securing the first cable guide with respect to the limb, and the first cable guide receiving an intermediate portion of the cable between the first and second ends;

a second cable guide retained at a second position adjustable along a width of the top end of the base, the second cable guide receiving a second intermediate portion of the cable between the first cable guide and the second end; and gripper means attached to the top end of the base whereby a user of the apparatus may grip the gripper means using the user's hands.

13. The apparatus of claim 12, wherein the gripper means is integral with at least one leg of an upright support structure of the apparatus.

14. The apparatus of claim 12, wherein the gripper means comprises a tubular member.

15. The apparatus of claim 12, wherein the gripper means comprises a handle device adapted to fit a human hand.

16. The apparatus of claim 12, wherein the gripper means comprises a U-shaped handle.

17. The apparatus of claim 12, wherein the gripper means is attached to the base adjacent at least one leg of an upright support structure of the apparatus.

18. The apparatus of claim 17, wherein the gripper means is foldably attached to the base.

19. The apparatus of claim 12, wherein the gripper means comprises a bar that runs parallel with a sliding bar.

20. The apparatus of claim 19, wherein a cross-section of the sliding bar is a square, a circle or a rectangle.

* * * * *